US011731258B2

(12) United States Patent
Eleftheriou

(10) Patent No.: US 11,731,258 B2
(45) Date of Patent: Aug. 22, 2023

(54) PNEUMATIC TOOL HOLDER

(71) Applicant: George Eleftheriou, Haverhill, MA (US)

(72) Inventor: George Eleftheriou, Haverhill, MA (US)

( * ) Notice: Subject to any disclaimer, the term of this patent is extended or adjusted under 35 U.S.C. 154(b) by 0 days.

(21) Appl. No.: 17/476,057

(22) Filed: Sep. 15, 2021

(65) Prior Publication Data

US 2022/0088764 A1 Mar. 24, 2022

Related U.S. Application Data

(60) Provisional application No. 63/081,116, filed on Sep. 21, 2020.

(51) Int. Cl.
*B25H 3/00* (2006.01)
*B25H 3/04* (2006.01)

(52) U.S. Cl.
CPC ..... *B25H 3/006* (2013.01); *B25H 3/04* (2013.01)

(58) Field of Classification Search
CPC ..... B25H 3/006; B25H 3/04
See application file for complete search history.

(56) References Cited

U.S. PATENT DOCUMENTS 2,503,737 A * 4/1950 Hodgkins ..... B25H 3/04 312/246
2,805,777 A * 9/1957 Larson ..... B25H 3/04 211/106.01
3,063,569 A * 11/1962 Huber ..... A47L 13/512 211/89.01
3,269,550 A * 8/1966 Marcus ..... B25H 3/04 248/220.42
3,298,531 A * 1/1967 Wilcke ..... A47L 13/512 211/70.6
3,337,058 A 8/1967 Sandrick ..... 211/69
3,603,551 A * 9/1971 Peterson ..... B25H 3/04 248/314
4,160,570 A * 7/1979 Bridges ..... A47F 5/0853 D6/571
4,211,455 A * 7/1980 Tedrow ..... B25H 3/02 312/902

(Continued)

OTHER PUBLICATIONS

"Air Tool Holder", https://mechanicstimesavers.com/products/air-tool-holder, accessed on Oct. 21, 2021, 4 Pages.

*Primary Examiner* — Stanton L Krycinski
(74) *Attorney, Agent, or Firm* — Hayes Soloway P.C.

(57) ABSTRACT

A pneumatic tool holder apparatus and related methods of storing pneumatic tools are disclosed. The pneumatic tool holder apparatus has a housing having a bottom plate. A plurality of keyholes is formed in the bottom plate. Each of the plurality of keyholes have an enlarged side and a non-enlarged side, where the enlarged side is sized to receive an end of a pneumatic tool coupling device and the non-enlarged side is sized smaller than a collar on the end of the pneumatic tool coupling device. A plurality of interior compartments is formed within the housing. Each interior compartment corresponds to one of the plurality of keyholes. When the end of the pneumatic tool coupling device is inserted through a keyhole and into an interior compartment, the interior compartment prevents debris from gaining access to a pneumatic interior of a pneumatic tool.

17 Claims, 7 Drawing Sheets

(56) References Cited

U.S. PATENT DOCUMENTS 4,343,172 A 8/1982 Nordlund ..... B21D 53/00
4,403,700 A * 9/1983 Manlove ..... B43M 99/008 211/88.01
4,446,972 A * 5/1984 Sussman ..... A47G 29/08 211/60.1
4,597,496 A 7/1986 Kaplan ..... A47F 5/08
4,653,637 A * 3/1987 Wallace ..... B25H 3/04 211/70.1
D294,548 S * 3/1988 Wallace ..... D6/558
5,004,103 A 4/1991 Connors et al. ..... B65B 85/20
5,386,915 A * 2/1995 Sirhan ..... B25H 3/04 211/13.1
5,513,758 A 5/1996 Lin ..... A47F 7/00
5,740,883 A * 4/1998 Trank ..... E06C 7/14 248/210
6,082,538 A 7/2000 Snider et al. ..... B65D 85/00
6,161,707 A * 12/2000 Lin ..... A47G 25/06 211/32
6,349,827 B1 2/2002 Feder ..... B65D 85/24
6,425,489 B1 7/2002 Cunningham ..... A47F 7/00
6,484,892 B1 11/2002 Gooner ..... A47F 7/00
6,499,608 B1 12/2002 Sterling et al. ..... A47F 7/00
6,641,099 B1 * 11/2003 Lue ..... B25H 3/04 248/314
6,763,955 B2 7/2004 Keis et al. ..... A47F 5/00
6,837,383 B1 * 1/2005 McElhaney, Jr. ..... B25H 5/00 211/70.6
D552,796 S * 10/2007 Petruccelli ..... D28/38
7,527,156 B2 5/2009 Wisnoski et al. ..... A47F 5/00
7,584,973 B2 9/2009 Brager ..... B62B 3/00
D602,724 S * 10/2009 Liu ..... D6/567
7,798,336 B2 * 9/2010 Shiao ..... B25H 3/04 211/DIG. 1
8,069,995 B2 * 12/2011 Winnard ..... B25H 3/003 211/89.01
D725,406 S * 3/2015 Olszewski ..... D6/567
9,056,756 B1 * 6/2015 De Marco ..... A47G 25/0614
9,101,189 B2 8/2015 Vuckov ..... A45F 5/00
9,763,496 B2 * 9/2017 Asplund ..... A44B 15/00
9,764,460 B2 * 9/2017 Winnard ..... B25H 3/04
10,213,915 B1 * 2/2019 DeMarco ..... B66F 13/00
10,357,875 B2 * 7/2019 Mefferd ..... B25H 3/04
10,392,817 B2 * 8/2019 Gross ..... E04F 21/1805
10,500,712 B2 * 12/2019 Ernst ..... B25H 3/04
10,773,375 B2 * 9/2020 Mefferd ..... B25H 3/003
2002/0104709 A1 * 8/2002 Hines ..... B25H 3/006 182/129
2005/0133393 A1 6/2005 Lawrence et al. ..... A45C 11/26
2006/0226096 A1 10/2006 Robins ..... A47F 7/00
2006/0243686 A1 * 11/2006 Grayson ..... A47B 81/005 211/70.6
2007/0138310 A1 * 6/2007 Magnani ..... B65D 85/24 238/1
2007/0210021 A1 9/2007 Whitehead et al. ..... A47F 7/00
2008/0000854 A1 * 1/2008 Rief ..... E04H 4/1654 211/70.6
2008/0035590 A1 2/2008 Huang ..... A47F 7/00
2013/0043201 A1 2/2013 Wang ..... A47F 7/00
2013/0048631 A1 2/2013 Van der Linde et al. ..... B25H 3/00
2016/0318661 A1 11/2016 Simakis ..... B65D 25/10
2017/0165830 A1 * 6/2017 Vaughan ..... A47B 81/005
2018/0207790 A1 * 7/2018 Daniel ..... B25F 3/00

* cited by examiner

PNEUMATIC TOOL HOLDER

CROSS REFERENCE TO RELATED APPLICATION

This application claims benefit of U.S. Provisional Application Ser. No. 63/081,116 entitled, "Pneumatic Tool Holder" filed Sep. 21, 2020, the entire disclosure of which is incorporated herein by reference.

FIELD OF THE DISCLOSURE

The present disclosure is generally related to a tool holder and more particularly is related to a pneumatic tool holder.

BACKGROUND OF THE DISCLOSURE

Pneumatic tools operate using a pressurized air supply which is transferred to the tool with a hose, tube, or similar structure. Commonly, the pneumatic tool connects to the supply hose with a coupling that allows the user to easily couple and decouple the pneumatic tool from the supply hose. These couplings may be referred to as a 'quick coupling' and they often have a male portion which is insertable into a receiver, the connection of which is controlled through a spring-biased cylindrical sleeve which holds the male portion in the receiver and can be pulled to release the male portion from the receiver.

When a pneumatic tool is not in use, the user often decouples it from the supply hose and places it away for storage. However, unlike mechanically or electrically operated tools which can be stored on shelves, in cabinets, or the like, pneumatic tools must be stored in such a way that prevents contamination of the interior air passages of the tool. If dust or similar contaminants are able to gain access to the pneumatic tool through the opening in the quick coupling, over time the dust can cause the tool to malfunction or degrade its quality. There exists the use of rubberized or plastic caps which can be placed directly over the male portion of the quick coupling, but these caps are prone to inadvertently falling off the quick coupling.

Thus, a heretofore unaddressed need exists in the industry to address the aforementioned deficiencies and inadequacies.

SUMMARY OF THE DISCLOSURE

Embodiments of the present disclosure provide a pneumatic tool holder apparatus and related methods of storing pneumatic tools. Briefly described, in architecture, one embodiment of the system, among others, can be implemented as follows. A housing has a bottom plate, the housing is mountable to a mounting structure with the bottom plate facing a ground surface. A plurality of keyholes is formed in the bottom plate, wherein each of the plurality of keyholes have an enlarged side and a non-enlarged side, the enlarged side sized to receive an end of a pneumatic tool coupling device and the non-enlarged side sized smaller than a collar on the end of the pneumatic tool coupling device. A plurality of interior compartments is formed within the housing, each interior compartment corresponding to one of the plurality of keyholes, wherein when the end of the pneumatic tool coupling device is inserted through a keyhole and into an interior compartment, the interior compartment prevents debris from gaining access to a pneumatic interior of a pneumatic tool.

The present disclosure can also be viewed as providing a system for storing pneumatic tools in a debris-free environment. Briefly described, in architecture, one embodiment of the system, among others, can be implemented as follows. The system comprises a pneumatic tool holder apparatus having: a housing having a bottom plate; a plurality of keyholes formed in the bottom plate, wherein each of the plurality of keyholes have an enlarged side and a non-enlarged side; and a plurality of interior compartments formed within the housing, each interior compartment corresponding to one of the plurality of keyholes. The housing is mountable to a mounting structure with the bottom plate facing a ground surface. At least one pneumatic tool is provided, wherein an end of a pneumatic tool coupling device attached to the at least one pneumatic tool is inserted through a keyhole and into an interior compartment, wherein the enlarged side is sized to receive the end of the pneumatic tool coupling device and the non-enlarged side sized smaller than a collar on the end of the pneumatic tool coupling device, and wherein the interior compartment prevents debris from gaining access to a pneumatic interior of the pneumatic tool.

The present disclosure can also be viewed as providing a pneumatic tool holder apparatus. Briefly described, in architecture, one embodiment of the apparatus, among others, can be implemented as follows. A housing has a bottom plate, a top plate, and side plates. The housing is mountable to a mounting structure with the bottom plate facing a ground surface. At least three keyholes are formed in the bottom plate, wherein each of the three keyholes have an enlarged side and a non-enlarged side, the enlarged side sized to receive an end of a pneumatic tool coupling device and the non-enlarged side sized smaller than a collar on the end of the pneumatic tool coupling device. At least three interior compartments are formed within the housing, the three interior compartments corresponding to the three keyholes, respectively, each of the interior compartments being substantially closed from an air flow except through the keyhole, wherein when the end of the pneumatic tool coupling device is inserted through the keyhole and into an interior compartment, the interior compartment prevents debris from gaining access to a pneumatic interior of a pneumatic tool.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
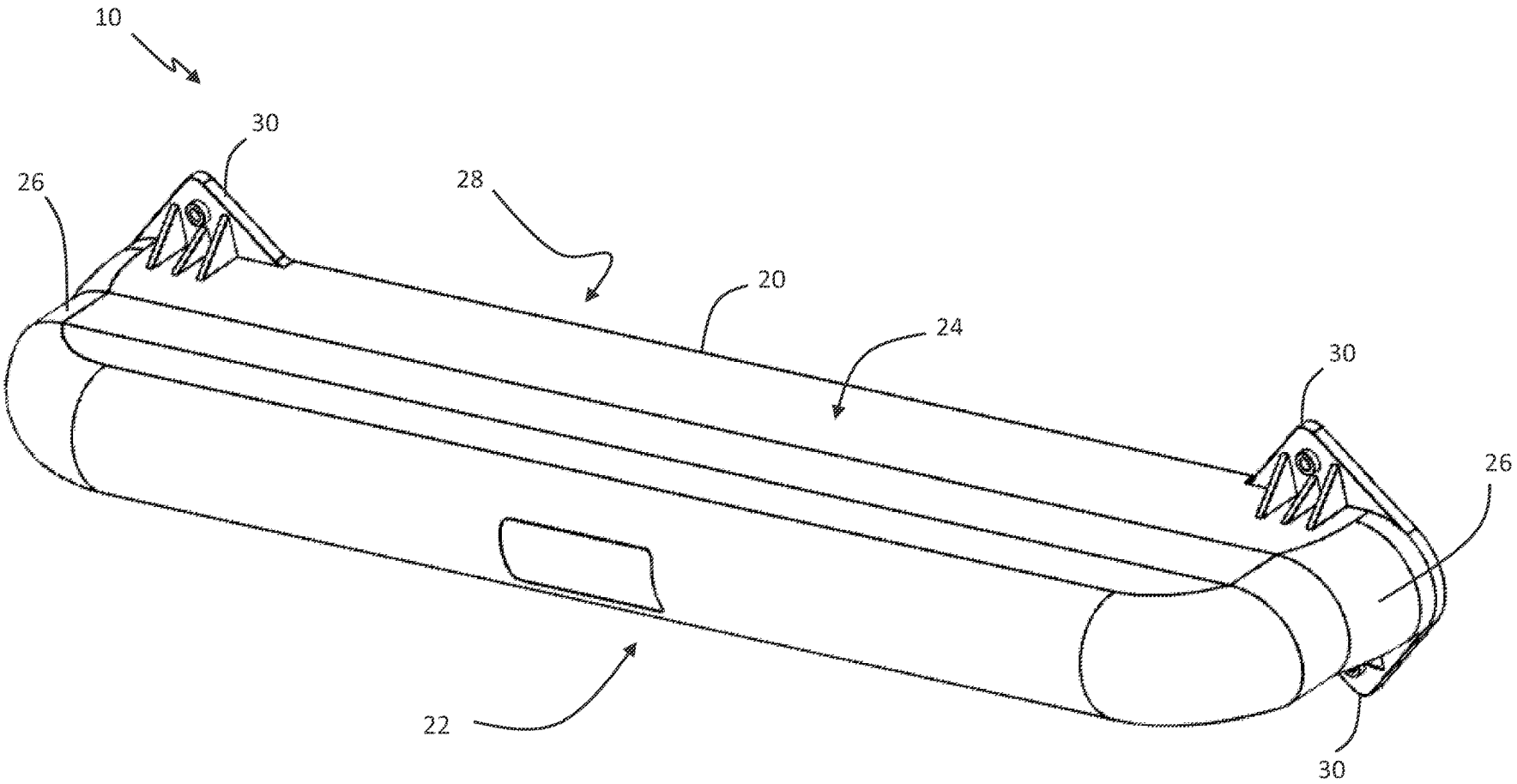
FIG. 1 is a top-view illustration of a pneumatic tool holder apparatus, in accordance with a first exemplary embodiment of the present disclosure.
Figure 2:
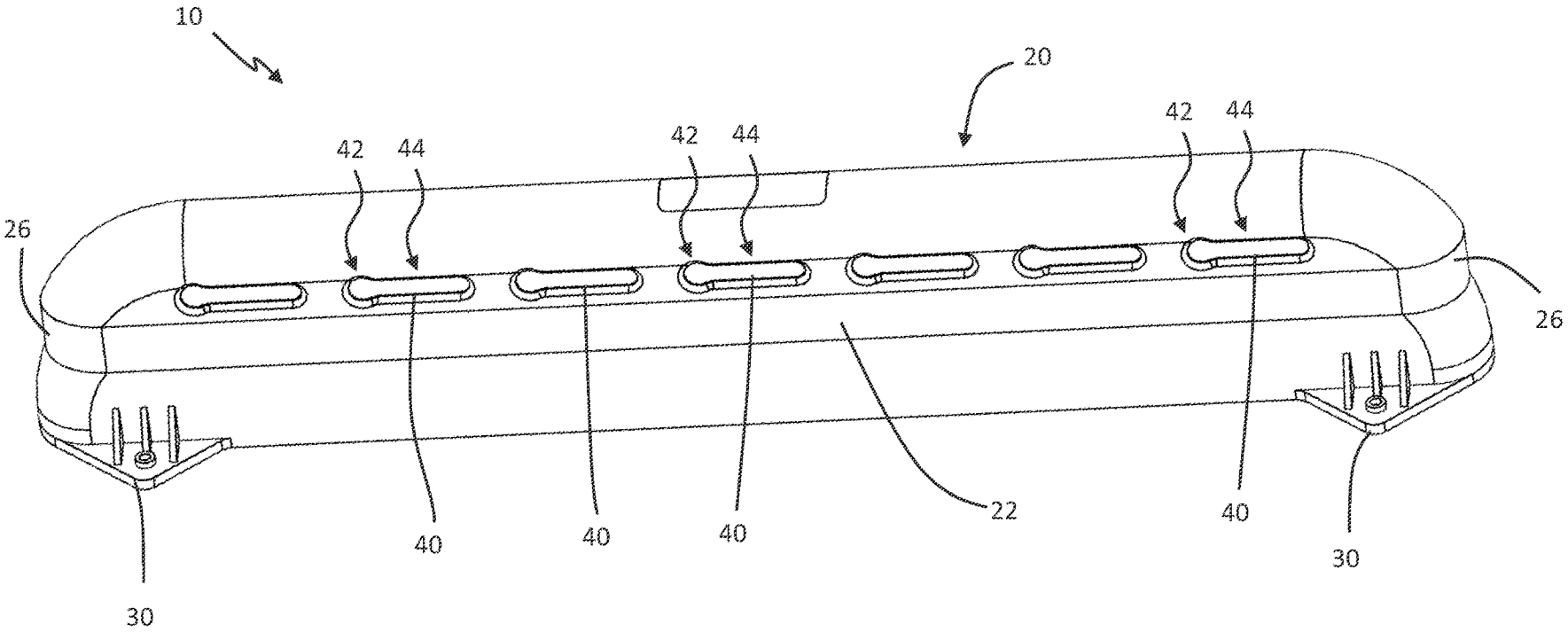
FIG. 2 is a bottom-view illustration of the pneumatic tool holder apparatus, in accordance with the first exemplary embodiment of the present disclosure.
Figure 3:
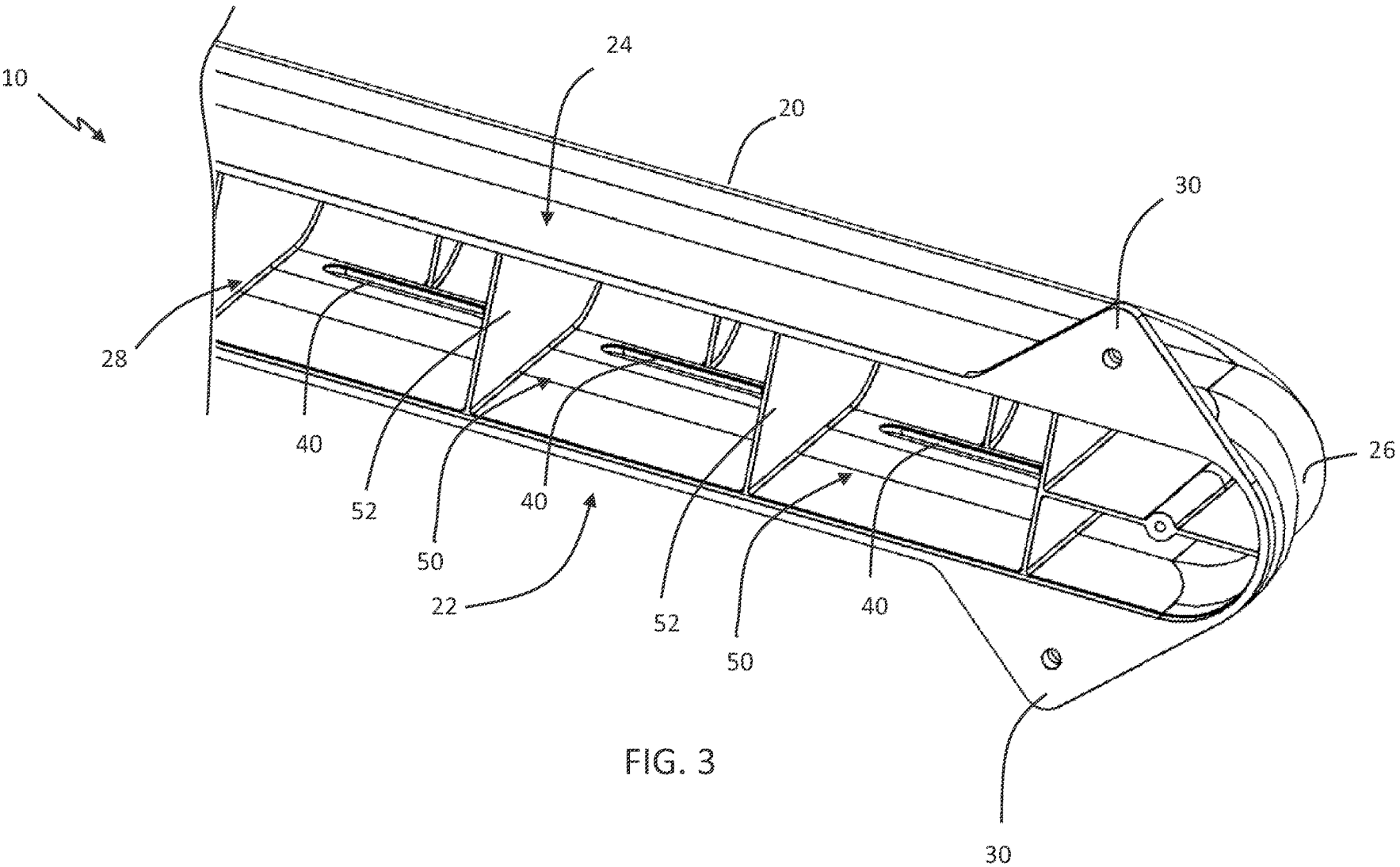
FIG. 3 is a rear-view illustration of the pneumatic tool holder apparatus, in accordance with the first exemplary embodiment of the present disclosure.

To overcome the problems in the field of storing pneumatic tools, the subject disclosure is directed to a pneumatic tool holder apparatus which allows for storage of pneumatic tools in such a manner to prevent dust or other debris from entering the interior of the tool and causing damage to it. FIGS. 1, 2, and 3 are top-view, bottom view, and rear-view illustrations, respectively, of the pneumatic tool holder apparatus 10, in accordance with a first exemplary embodiment of the present disclosure.

With reference to FIGS. 1-3, the pneumatic tool holder apparatus 10 has a housing 20, which is generally formed as a substantially unitary structure with a bottom plate 22, a top plate 24, and side portions 26, all connected or formed to one another. In a normal working orientation of the apparatus 10, the apparatus 10 is mounted with a rear portion 28 thereof positioned against a mounting structure, such as a wall, such that the bottom plate 22 of the housing 20 is positioned facing downwards or towards a ground surface. In this position, the top plate 24 of the housing would face substantially upwards and the side portions 26 would be positioned in an approximate vertical orientation.

To mount the apparatus 10 to the mounting structure, the housing 20 includes at least one fixture structure 30, and often four fixture structures 30, which is integrally connected to or formed with the housing 20. These fixture structures 30 may have a hole which receives a fastener 32, such as a threaded or non-threaded fastener, e.g., screw, bolt, nail, etc. (FIG. 5) which can be used to mount the apparatus to the mounting structure, such as a wall, a tool bench, or any other structure which is capable of holding the apparatus 10. It is noted that the fixture structure 30 may include other types of structures, designs, or quantities beyond what is depicted in the figures. FIG. 3 illustrates the rear portion 28 of the apparatus 10 which is depicted being open, such that the interior of the housing 20 can be seen. As shown, the interior of the housing 20 has an open interior with a plurality of compartments 50 formed with separating partitions 52 therebetween. Each of the compartments 50 correspond to the location of a keyhole 40 formed within the bottom plate 22.

Figure 4:
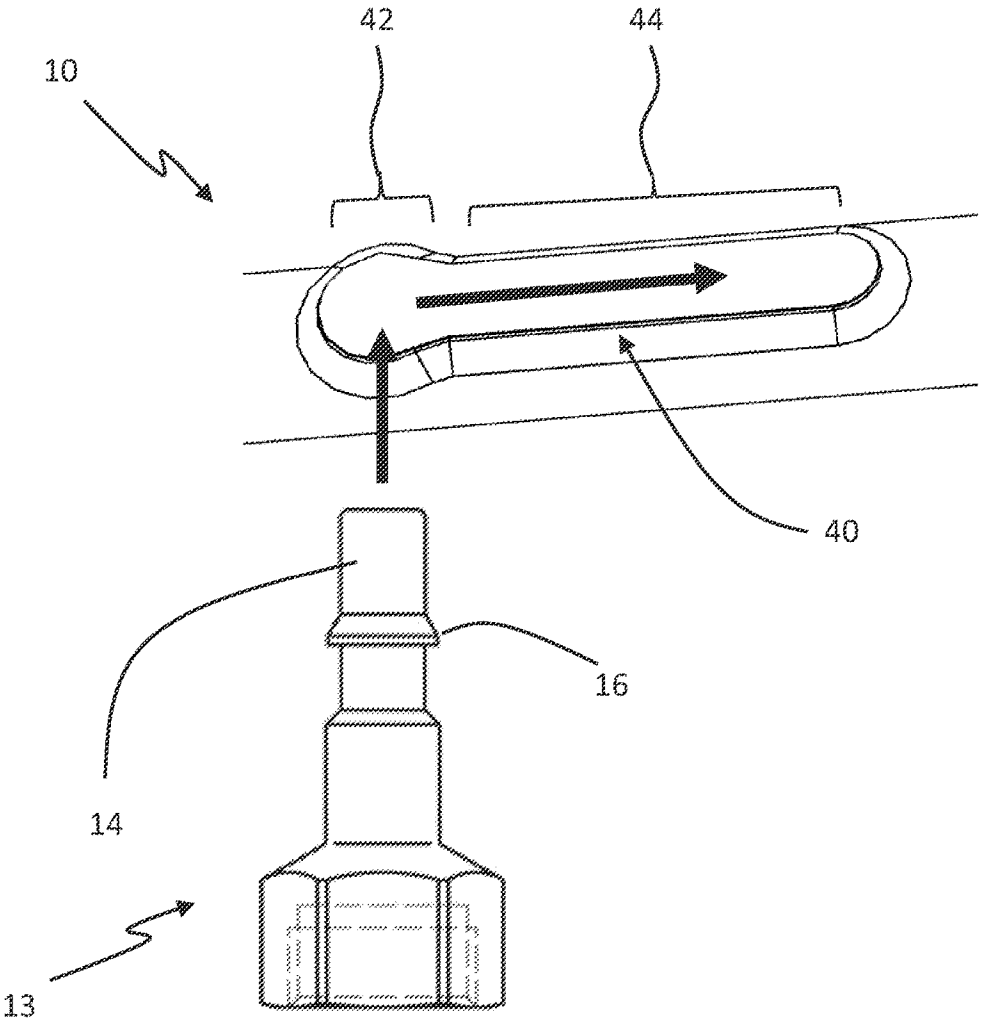
FIG. 4 is a diagrammatical illustration of the keyhole of the pneumatic tool holder apparatus, in accordance with the first exemplary embodiment of the present disclosure.

FIGS. 2-3 best illustrate the housing 20 with the plurality of keyholes 40 formed in the bottom plate 22. The keyholes each have an enlarged side 42 which may be understood to have a wider opening than a non-enlarged side 44, which is generally shaped as a more narrow, elongated slot within the bottom plate 22. The keyholes 40 are sized to receive the pneumatic quick coupling devices 13 which are used to connect the pneumatic tool to a hose. FIG. 4 is a diagrammatical illustration of the keyhole of the pneumatic tool holder apparatus 10, in accordance with the first exemplary embodiment of the present disclosure.

As shown in FIGS. 2-4, the terminating male end 14 of the pneumatic connector 13 can be inserted into an enlarged side 42 of the keyhole 40, as depicted in FIG. 4. The male end 14 of the pneumatic connector 13 may be substantially cylindrical in shape with one or more collars 16 positioned on an exterior surface thereof, such that the male end 14 is inserted through the enlarged side 42 of the keyhole 40 to a position past the collar 16. The non-enlarged side 44 of the keyhole 40 is sized to be smaller than the collar 16 of the male end 14, such that when the male end 14 is inserted into the keyhole 40 and moved sideways within the keyhole 40, i.e., from the enlarged side 42 to the non-enlarged side 44, the collar 16 contacts the interior surface of the bottom plate 22 and prevents the male end 14 from being removed from the keyhole 40 without sliding it back towards the enlarged side 42. The specific dimensional size of the keyhole 40, the enlarged side 42, and the non-enlarged side 44 may vary to receive the shapes, sizes, and contours of various sized pneumatic connectors, all of which are considered within the scope of the present disclosure.

Figure 5:
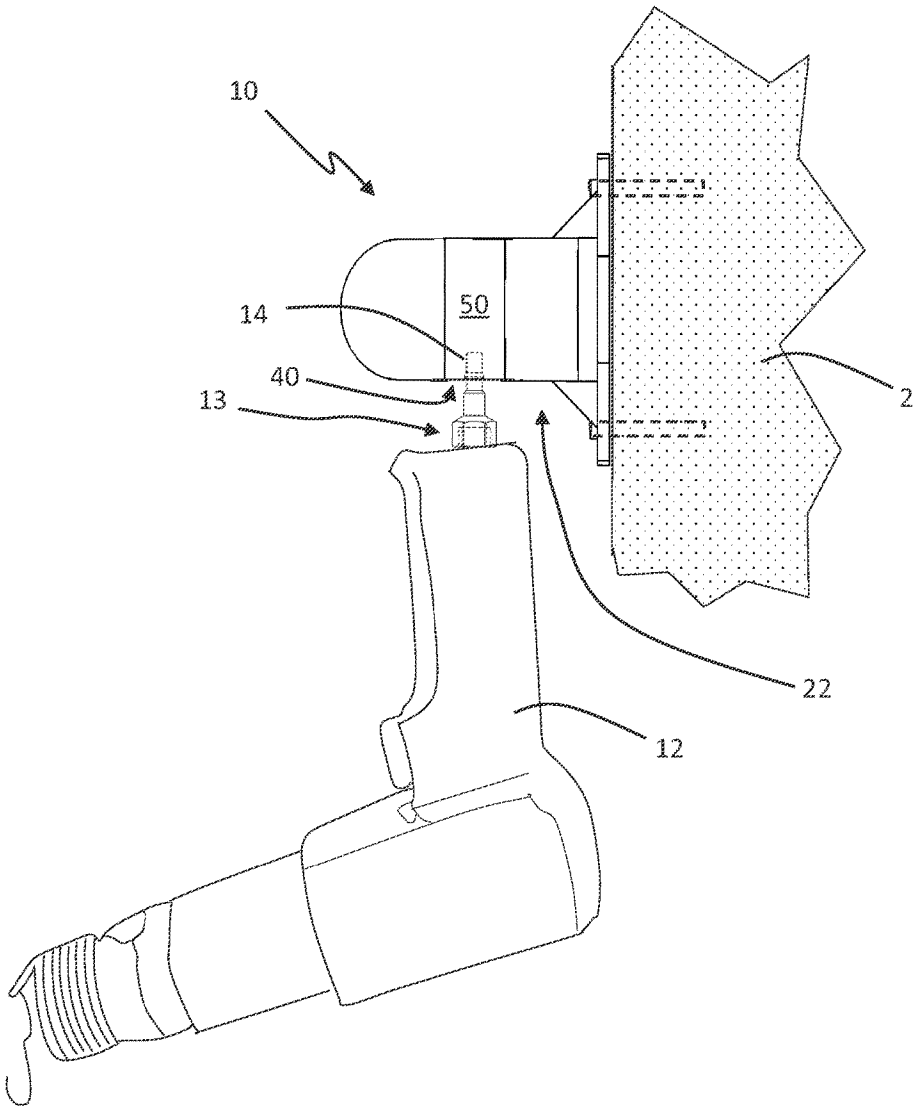
FIG. 5 is a diagrammatical illustration of the pneumatic tool holder apparatus in use with a pneumatic tool, in accordance with the first exemplary embodiment of the present disclosure.

FIG. 5 is a diagrammatical illustration of the pneumatic tool holder apparatus 10 in use with a pneumatic tool 12, in accordance with the first exemplary embodiment of the present disclosure. With reference to FIG. 5, when a pneumatic tool 12 with a male end 14 of the quick coupling device 13 is placed in use with the apparatus 10, the pneumatic tool 12 may be in a position where it hangs from the apparatus 10, in particular, hangs from the bottom plate 22 of the apparatus 10, as the male end 14 of the quick coupling device 13 is positioned through the keyhole 40. As shown, the apparatus 10 may be mounted to a mounting structure 2, such as a wall or workbench, with the bottom plate 22 facing downwards, e.g., towards the ground surface. In this position, the opening of the male end 14 of the connector may be located within the apparatus 10 itself, and in particular, within an interior compartment 50 formed within the apparatus 10.

With reference back to FIG. 3, the interior compartments 50 may be formed between the bottom plate 22, the top plate 24, and the front sidewall of the housing 20. Additionally, a partition 52 is positioned within the housing 20 to separate the interior compartments 50, each of which corresponds to a location of a keyhole 40, such that each keyhole 40 is substantially separated or confined from a neighboring keyhole 40. The partitions 52 may be formed integrally with the housing, such that there are no air gaps, spaces, or other openings between the individual interior compartments 50. While the partitions 52 act to create separate compartments for each keyhole 40, importantly, the partitions also prevent the flow of air by drafts or negative pressures from moving through or across the interior of the apparatus 10, such as from one keyhole 40 to another. By preventing drafts of air between the interior compartments 50, it is possible to further prevent the infiltration of dust and other contaminants from entering the pneumatic tool through the quick coupling device.

Referring to FIGS. 3-4, when the pneumatic tool 12 is positioned in use with the apparatus 10, the male end 14 portion of the quick coupling connector 13, and in particular, the portion of the male end 14 up to the collar 16, which includes the aperture for receiving the pneumatic air (which is transferred to the inner components of the pneumatic tool), is located within an interior compartment 50, e.g., between the bottom plate 22, top plate 24, the rear portion 28 of the housing 20, and the partitions 52. When the apparatus 10 is mounted to a mounting structure (FIG. 3 depicts the back portion 28 of the apparatus 10 open for clarity), the only access to the interior compartment where the male end 14 is located is substantially through the keyhole 40 itself. Since the bottom plate 22 with the keyholes 40 is positioned towards the ground surface, dust and other contaminants which generally move with gravity in a downwards direction cannot enter the interior compartment 50, and therefore, cannot easily gain access to the interior of the pneumatic tool 12. Thus, when a pneumatic tool 12 is used with the apparatus 10, it can effectively be stored in a manner which prevents contamination due to dust and other debris from gaining access to the interior components of the pneumatic tool 12 which prevents degradation and damage to the pneumatic tool 12.

Figure 6:
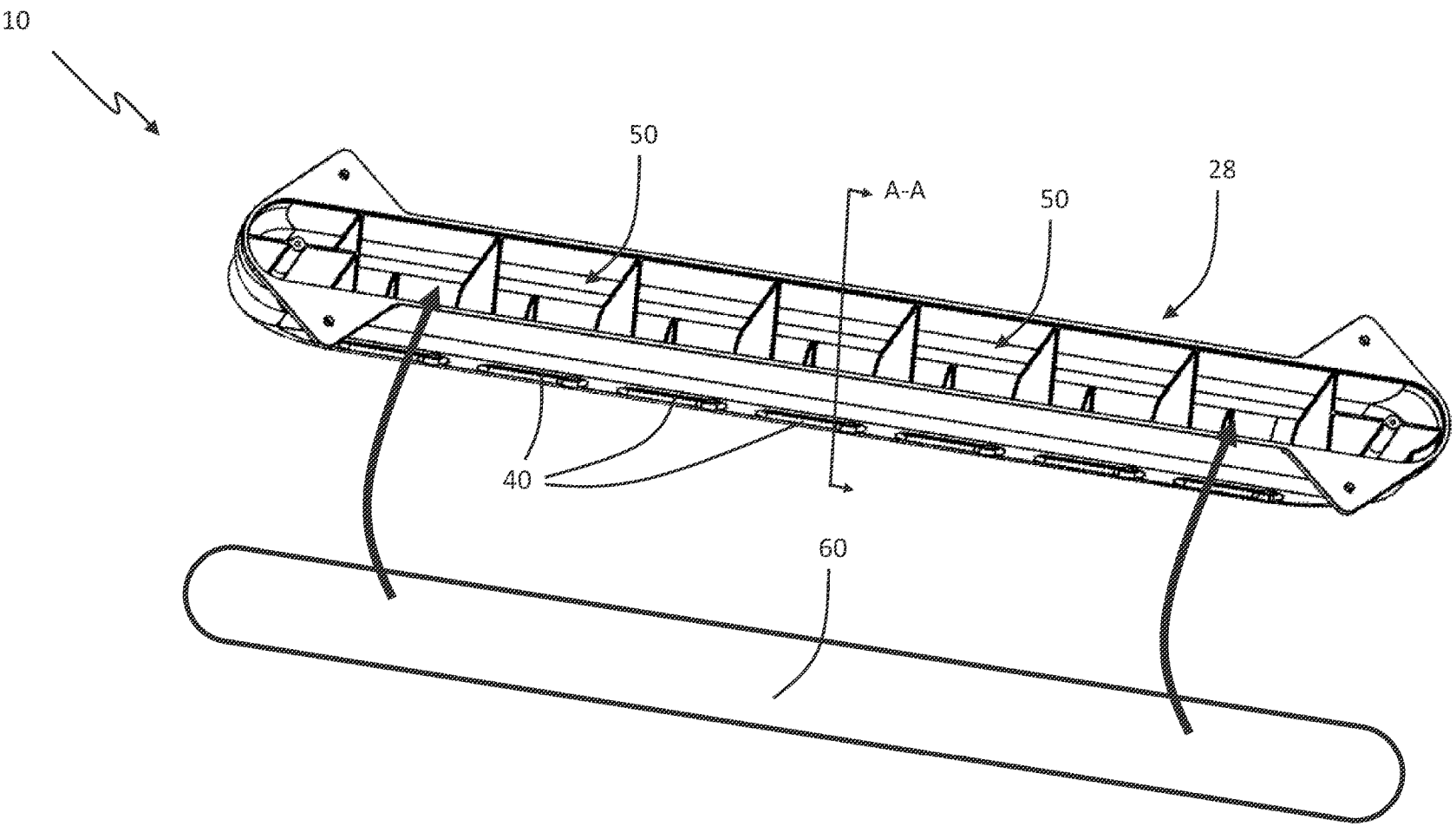
FIG. 6 is a rear-view illustration of the pneumatic tool holder apparatus, in accordance with the first exemplary embodiment of the present disclosure.

FIG. 6 is a rear-view illustration of the pneumatic tool holder apparatus 10, in accordance with the first exemplary embodiment of the present disclosure. With reference to FIG. 6, it is noted that the apparatus 10 may commonly be mounted to a mounting structure, such as a wall, which can effectively serve as the rear face of the housing 20, thereby enclosing the interior compartments 50. However, if the apparatus 10 is mounted against a mounting structure which is not solid, such as a pegboard or similar structure, the apparatus 10 can be used with a rear plate 60 which is sized to enclose the interior compartments 50 formed therein. In particular, the rear plate 60 may be positioned along an entirety of the rear portion 28 of the housing 20, such that the rear plate 60 prevents the infiltration of dust and other contaminants into the interior compartments 50. When the rear plate 60 is used, the only access to each interior compartment 50 is through the keyhole 40 itself.

Figure 7:
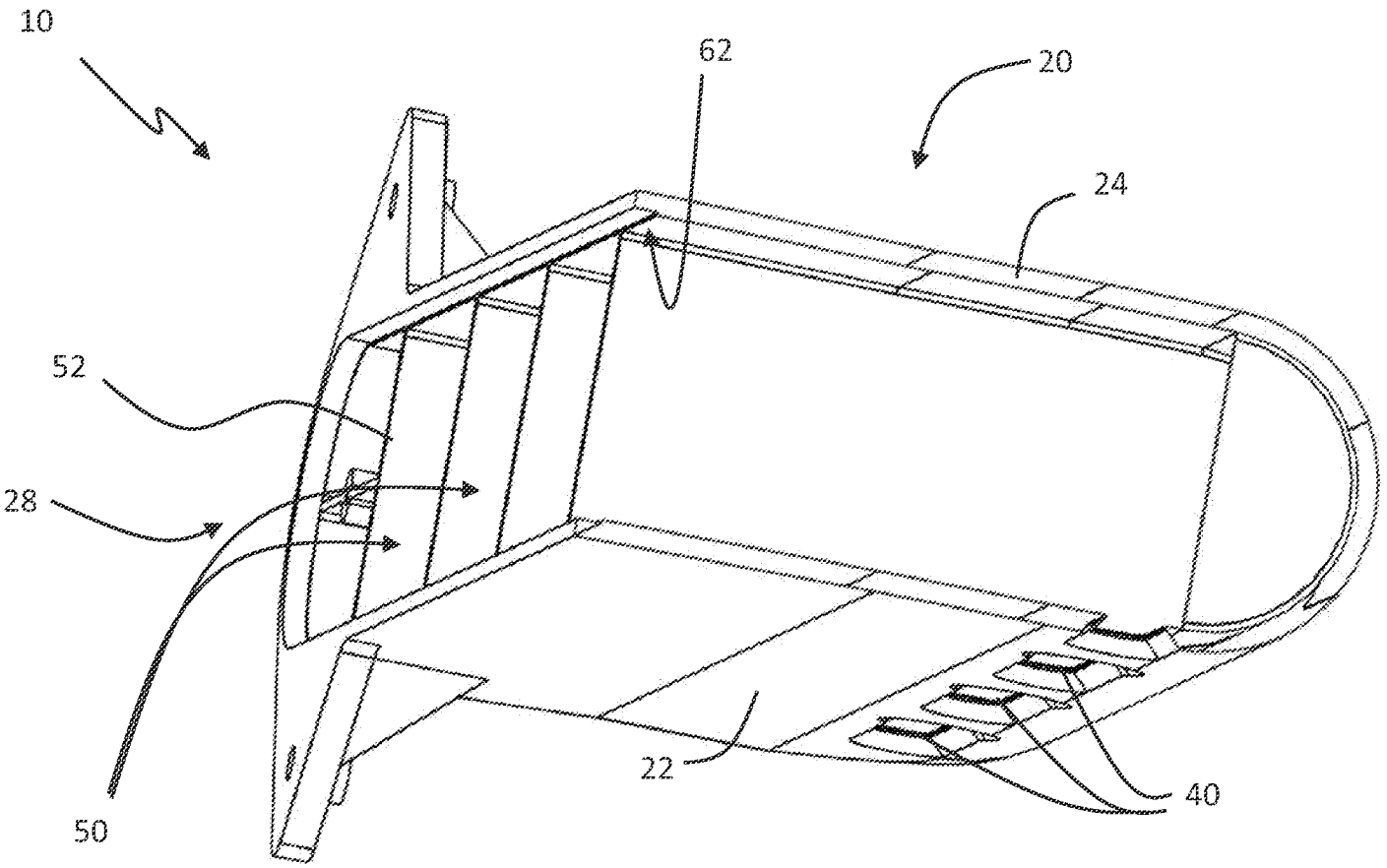
FIG. 7 is a cross-sectional illustration of the pneumatic tool holder apparatus of FIG. 6 along the line A-A, in accordance with the first exemplary embodiment of the present disclosure.

FIG. 7 is a cross-sectional illustration of the pneumatic tool holder apparatus 10 of FIG. 6 along the line A-A, in accordance with the first exemplary embodiment of the present disclosure. As shown in FIG. 7, the housing 20 may include a recessed edge 62 along the back portion 28, which is generally positioned around the edges of the housing 20 at the back portion 28. This recessed edge 62 may be sized to receive the rear plate 60 (FIG. 6) such that when the rear plate 60 is positioned against the housing 20, the rear plate 60 is positioned substantially flush or even with the rear surface of the housing 20. As such, the recessed edge 62 prevents the rear plate 60, when used, from protruding beyond the rear surface of the housing 20, which ensures the housing can sit flat against a mounting surface. In the installed position, the rear plate 60 may contact the edges of the housing 20 at the rear portion 28 and may contact the rear edges of the partitions 52, such that the rear plate 60 substantially closes the back part of each interior compartment 50.

Also shown in FIG. 7 is the shape of the keyholes 40, and in particular, the angled or chamfered edges of the keyholes 40. This design allows for easier insertion of the male end 14 of the quick coupling connector 13 into the keyhole 40, since the angled sides of the keyhole 40 help direct the male end 14 into the interior compartment 50. While the edges of the opening of the keyhole 40 may be angled, the housing 20 overall is manufactured from a durable material such that the weight of the pneumatic tool 12 can be supported without deforming the housing 20.

It is noted that the apparatus 10 may include any number of variations, features, or design changes. For example, the keyholes 40 may be sized to have the tolerance fit with a particular pneumatic connector, such that the pneumatic connector is reliably held within the keyhole 40 with sufficient material strength in the bottom plate 22 to ensure proper support for the weight of the pneumatic tool 12. Commonly, the apparatus 10 may be formed from molded plastics or similar materials, such as fiberglass or composites, such that the apparatus is durable and has the strength to support a number of pneumatic tools simultaneously. In one example, the apparatus 10 may be molded from plastic and include impregnated fiberglass in certain portions of the apparatus 10, such as a 40% fiberglass content, to increase the durability and strength with holding tools. It is further noted that manufacturing the apparatus 10 from plastic may provide benefits to prevent unnecessary wear and tear on the male ends 14 of the pneumatic connectors, e.g., such that they are not scratched or worn down over repeated uses of inserting and removing the pneumatic tool from the apparatus 10.

When the apparatus 10 is mounted to the mounting structure, it may be advantageous to mount it at a slight angle relative to a horizontal measurement, such that the non-enlarged side 44 of the keyholes 40 are slightly lower than the enlarged side 42, which may prevent the pneumatic tool from moving sideways and inadvertently dislodging from the keyhole 40. In one example, a mounting at a 2° angle may be used, however, other angles are also permissible. The apparatus 10 may also be fitted with structures along the keyhole 40 within the interior compartment, such as a ramp or a high-friction material, such as rubber, which can also prevent inadvertent removal of the pneumatic tool from the apparatus 10. Various other additions, changes, and modifications may also be used without departing from the scope of the present disclosure.

It is also noted that when the apparatus 10 is installed against a mounting structure, the top plate 24 of the housing 20 may serve as a shelf or holder for other tools. In particular, the top plate 24 may be a substantially planar surface which is capable of receiving objects and materials thereon and storing them. This allows the apparatus 10 to be used for both holding pneumatic tools 12 and providing storage for other tools and accessories.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A pneumatic tool holder apparatus comprising:

a housing having a bottom plate, the housing mountable to a mounting structure with the bottom plate facing a ground surface;

a plurality of keyholes formed in the bottom plate, wherein each of the plurality of keyholes have an enlarged side and a non-enlarged side, the enlarged side sized to receive an end of a pneumatic tool coupling device and the non-enlarged side sized smaller than a collar on the end of the pneumatic tool coupling device; and a plurality of interior compartments formed within the housing, each interior compartment corresponding to one of the plurality of keyholes, wherein each of the plurality of interior compartments is separated from adjacent interior compartments with at least one partition that extends from the bottom plate and a top plate of the housing, wherein the at least one partition is integrally and inseparably formed with the bottom and top plates by molding the at least one partition with both the bottom plate and the top plate, wherein when the end of the pneumatic tool coupling device is inserted through one of the keyholes and into one of the interior compartments, the interior compartment prevents debris from gaining access to a pneumatic interior of a pneumatic tool, and wherein a weight of the pneumatic tool is supported by the bottom plate, the at least one partition, and the tog plate without deforming the housing.

2. The pneumatic tool holder apparatus of claim 1, wherein the at least one partition prevents air flow between the plurality of interior compartments.

3. The pneumatic tool holder apparatus of claim 1, further comprising at least one fixture structure connected to the housing, the at least one fixture structure facilitating mounting of the housing to the mounting structure.

4. The pneumatic tool holder apparatus of claim 3, further comprising at least four fixture structures connected to the housing.

5. The pneumatic tool holder apparatus of claim 1, further comprising a rear plate removably positionable along a rear portion of the housing.

6. The pneumatic tool holder apparatus of claim 5, wherein the rear plate is removably positionable within a recessed edge along the rear portion of the housing, wherein the rear plate does not extend beyond the rear surface of the housing.

7. The pneumatic tool holder apparatus of claim 5, wherein the rear plate contacts at least one partition positioned between the plurality of compartments.

8. The pneumatic tool holder apparatus of claim 1, wherein the top plate of the housing is substantially planar, wherein the top plate is sized to be a shelf.

9. A system for storing pneumatic tools in a debris-free environment, the system comprising:

a pneumatic tool holder apparatus having:

a housing having a bottom plate;

a plurality of keyholes formed in the bottom plate, wherein each of the plurality of keyholes have an enlarged side and a non-enlarged side; and a plurality of interior compartments formed within the housing, each interior compartment corresponding to one of the plurality of keyholes, wherein each of the plurality of interior compartments is separated from adjacent interior compartments with at least one partition that extends from the bottom plate and a top plate of the housing, wherein the at least one partition is integrally and inseparably formed with the bottom and top plates by molding the at least one partition with both the bottom late and the to plate;

a mounting structure, wherein the housing is mountable to the mounting structure with the bottom plate facing a ground surface; and at least one pneumatic tool, wherein an end of a pneumatic tool coupling device attached to the at least one pneumatic tool is inserted through one of the keyholes and into an interior compartment, wherein the enlarged side is sized to receive the end of the pneumatic tool coupling device and the non-enlarged side sized smaller than a collar on the end of the pneumatic tool coupling device, and wherein the interior compartment prevents debris from gaining access to a pneumatic interior of the pneumatic tool, and wherein a weight of the pneumatic tool is supported by the bottom plate, the at least one partition, and the top plate without deforming the housing.

10. The system of claim 9, wherein the at least one partition prevents air flow between the plurality of interior compartments.

11. The system of claim 9, wherein the pneumatic tool apparatus further comprises at least one fixture structure connected to the housing, the at least one fixture structure facilitating mounting of the housing to the mounting structure.

12. The system of claim 11, further comprising at least four fixture structures connected to the housing.

13. The system of claim 9, wherein the pneumatic tool apparatus further comprises a rear plate removably positionable along a rear portion of the housing.

14. The system of claim 13, wherein the rear plate is removably positionable within a recessed edge along the rear portion of the housing, wherein the rear plate does not extend beyond the rear surface of the housing.

15. The system of claim 13, wherein the rear plate contacts at least one partition positioned between the plurality of compartments.

16. The system of claim 9, wherein the top plate of the housing is substantially planar wherein the top plate is sized to be a shelf.

17. A pneumatic tool holder apparatus comprising:

a housing having a bottom plate, a top plate, and side plates, the housing mountable to a mounting structure with the bottom plate facing a ground surface;

at least three keyholes formed in the bottom plate, wherein each of the three keyholes have an enlarged side and a non-enlarged side, the enlarged side sized to receive an end of a pneumatic tool coupling device and the non-enlarged side sized smaller than a collar on the end of the pneumatic tool coupling device; and at least three interior compartments formed within the housing, the three interior compartments corresponding to the three keyholes, respectively, wherein each of the three interior compartments is separated from adjacent interior compartments with at least one partition that extends from the bottom plate and the top plate of the housing, wherein the at least one partition is integrally and inseparably formed with the bottom and top plates by mold the at least one partition with both the bottom plate and the top plate, such that each of the interior compartments is substantially closed from an air flow except through the keyhole, wherein when the end of the pneumatic tool coupling device is inserted through one of the keyholes and into one of the interior compartments, the interior compartment prevents debris from gaining access to a pneumatic interior of a pneumatic tool, and wherein a weight of the pneumatic tool is supported by the bottom plate, the at least one partition, and the top plate without deforming the housing.

* * * * *